US010302096B2

(12) United States Patent
Kang et al.

(10) Patent No.: US 10,302,096 B2
(45) Date of Patent: May 28, 2019

(54) SCROLL FOR AIR CONDITIONER AND AIR CONDITIONER HAVING THE SAME

(71) Applicant: SAMSUNG ELECTRONICS CO., LTD., Suwon-si, Gyeonggi-do (KR)

(72) Inventors: Yong-hun Kang, Seoul (KR); Jin-baek Kim, Suwon-si (KR); Eung-ryeol Seo, Suwon-si (KR); Min-gi Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 581 days.

(21) Appl. No.: 14/988,175

(22) Filed: Jan. 5, 2016

(65) Prior Publication Data

US 2016/0238027 A1 Aug. 18, 2016

(30) Foreign Application Priority Data

Feb. 16, 2015 (KR) ..... 10-2015-0023568

(51) Int. Cl.

| | |
|---|---|
| ***F04D 17/16*** | (2006.01) |
| ***F04D 29/42*** | (2006.01) |
| ***F04D 25/08*** | (2006.01) |
| ***F04D 29/58*** | (2006.01) |
| ***F04D 29/28*** | (2006.01) |

(Continued)

(52) U.S. Cl.

CPC ..... *F04D 29/4233* (2013.01); *F04D 17/16* (2013.01); *F04D 25/08* (2013.01); *F04D 29/281* (2013.01); *F04D 29/283* (2013.01); *F04D 29/4226* (2013.01); *F04D 29/441* (2013.01);

(Continued)

(58) Field of Classification Search

CPC . F04D 29/283; F04D 29/4233; F04D 29/4226

See application file for complete search history.

(56) References Cited

U.S. PATENT DOCUMENTS 5,741,118 A * 4/1998 Shinbara ..... F04D 29/283 416/185

8,075,262 B2 * 12/2011 Watanabe ..... F04D 29/4233 415/119

(Continued)

FOREIGN PATENT DOCUMENTS

| | | |
|---|---|---|
| EP | 0 707 149 A1 | 4/1996 |
| EP | 2 314 880 B1 | 1/2013 |

(Continued)

OTHER PUBLICATIONS

Extended European Search Report dated Jul. 25, 2016 in corresponding European Patent Application No. 16151364.3.

*Primary Examiner* — Woody A Lee, Jr.

(74) *Attorney, Agent, or Firm* — Staas & Halsey LLP

(57) ABSTRACT

An air conditioner includes a scroll body comprising an inlet through which air is introduced, an outlet through which the air is discharged, and an air passage between the inlet and the outlet, a sirocco fan rotatably disposed in the scroll body, the sirocco fan configured to allow the air to be sucked through the inlet and to be discharged through the outlet when the sirocco fan rotates, and a bell mouth formed around the inlet of the scroll body, wherein the scroll body and the sirocco fan satisfy a following formula: $0.76 \leq H/D \leq 0.8$, where H (mm) is a height of the scroll body, and D (mm) is an outer diameter of the sirocco fan.

20 Claims, 18 Drawing Sheets

(51) Int. Cl.
*F04D 29/44* (2006.01)
*F24F 1/0022* (2019.01)

(52) U.S. Cl.
CPC ..... *F04D 29/5826* (2013.01); *F24F 1/0022* (2013.01)

(56) References Cited

U.S. PATENT DOCUMENTS

| | | | | |
|---|---|---|---|---|
| 9,745,983 | B2 * | 8/2017 | Pihet | F04D 29/4226 |
| 2002/0131861 | A1 * | 9/2002 | Sakai | F04D 29/422 415/204 |
| 2008/0310957 | A1 | 12/2008 | Lyons | |
| 2011/0103945 | A1 | 5/2011 | Tokunaga et al. | |
| 2013/0092357 | A1 | 4/2013 | Sato et al. | |

FOREIGN PATENT DOCUMENTS

| | | | |
|---|---|---|---|
| EP | 2 835 585 | A1 | 2/2015 |
| EP | 2 894 344 | A1 | 7/2015 |
| JP | 2005-30410 | | 2/2005 |
| JP | 2008-267242 | | 11/2008 |
| JP | 2011-190748 | | 9/2011 |
| KR | 10-2000-0055690 | A | 9/2000 |
| KR | 10-0845289 | | 7/2008 |
| KR | 20-2009-0001371 | | 2/2009 |
| KR | 10-10-45750 | B1 | 6/2011 |
| WO | WO 2014/038465 | A1 | 3/2014 |

* cited by examiner

SCROLL FOR AIR CONDITIONER AND AIR CONDITIONER HAVING THE SAME

CROSS-REFERENCE TO RELATED APPLICATIONS

This application claims priority benefit from Korean Patent Application No. 10-2015-0023568 filed Feb. 16, 2015 in the Korean Intellectual Property Office, the disclosure of which is incorporated herein by reference in its entirety.

BACKGROUND

1. Field

The present disclosure relates to an air conditioner. More particularly, the present disclosure relates to a scroll for an air conditioner provided with a sirocco fan therein and an air conditioner having the same.

2. Description of the Related Art

Generally, sirocco fans that may blow wind of a band shape with a wide width toward the indoor are widely used in a ceiling type air conditioner disposed in a ceiling of a room.

The sirocco fan has a plurality of blades, and is disposed inside a scroll. When the sirocco fan rotates, the sirocco fan generates a pressure change to form a flow field.

The scroll has a function that collects air discharged from the sirocco fan and pushes the air toward of the outside of the scroll. The scroll changes dynamic pressure of the air discharged from the sirocco fan into static pressure, thereby increasing the static pressure at the outlet. Accordingly, the shape of the scroll gives a lot of effects to the performance of the sirocco fan.

As illustrated in FIG. 1, a conventional scroll 100 is provided with a bell mouth 110 to reduce flow resistance of external air in an inlet 101 through which the external air is introduced. However, the conventional bell mouth 110 is formed in a round shape having a predetermined curvature as illustrated in FIG. 1.

In the conventional round shaped bell mouth 110, since layered suction flow is formed in the vicinity of the bell mouth 110 as illustrated in FIG. 2, there is great difference in pressure distribution due to the shape of the bell mouth 110. Accordingly, the suction flow is unstable due to the difference in the pressure distribution in the vicinity of the bell mouth 110 so that the blowing efficiency of the sirocco fan is degraded. In reference, since a dark portion represents a low pressure area and a light portion represents a high pressure area in FIG. 2, it can be seen that the pressure of an area closer to the bell mouth 110 is lower.

SUMMARY

The present disclosure has been developed in order to overcome the above drawbacks and other problems associated with the conventional arrangement. An aspect of the present disclosure relates to a scroll for an air conditioner having a shape capable of maximizing a blowing efficiency of a sirocco fan in accordance with a height of the air conditioner.

Another aspect of the present disclosure relates to blades of a sirocco fan having a shape capable of maximizing a blowing efficiency of the sirocco fan.

According to an aspect of the present disclosure, an air conditioner may include a scroll body comprising an inlet through which air is introduced, an outlet through which the air is discharged, and an air passage between the inlet and the outlet; a sirocco fan rotatably disposed in the scroll body, the sirocco fan configured to allow the air to be sucked through the inlet and to be discharged through the outlet when the sirocco fan rotates; and a bell mouth formed around the inlet of the scroll body, wherein the scroll body and the sirocco fan satisfy a following formula:

$$0.76 \le D/H \le 0.8$$

where H (mm) is a height of the scroll body, and D (mm) is an outer diameter of the sirocco fan.

The bell mouth may be formed in a two-step structure extending from a side wall of the scroll body to an inside of the scroll body so that inner diameters of the bell mouth are smaller toward the inside of the scroll body.

The bell mouth may include a first inclined portion which is bent inwardly extending from the side wall of the scroll body; a flat portion which is bent substantially parallel to the side wall of the scroll body and extends from the first inclined portion; and a second inclined portion which is bent inwardly extending from the flat portion.

The scroll for an air conditioner may include a cutoff formed in an upper surface of the outlet of the scroll body, wherein the cutoff is formed in a position to satisfy a following formula:

$$0.13 \le Sv/Sh \le 0.15$$

where Sv is a vertical distance from a center of the inlet of the scroll body to an apex of the cutoff, and Sh is a horizontal distance from the center of the inlet of the scroll body to the apex of the cutoff.

The scroll body may include a circumferential surface formed of a plurality of curved surfaces whose radii from the center of the inlet of the scroll body are different, wherein the plurality of curved surfaces may include a first circumferential surface connected to the outlet and a second circumferential surface connected to the first circumferential surface, and wherein the circumferential surface of the scroll body may be formed to satisfy a following formula:

$$0.7 \le V2/V1 \le 0.75$$

where V1 is a radius from the center of the inlet of the scroll body to the first circumferential surface of the scroll body, and V2 is a radius from the center of the inlet of the scroll body to the second circumferential surface of the scroll body.

The sirocco fan may include a pair of rings to face each other; and a plurality of blades disposed between the pair of rings, and wherein an end of each of the plurality of blades in contact with the pair of rings is formed to have a step.

The step of the blade may have a height of about 5% of a length of the blade.

The sirocco fan may include a pair of rings to face each other; and a plurality of blades disposed between the pair of rings, and wherein each of the plurality of blades satisfies following formulas:

$$0.17 \le B/L \le 0.2,$$

$$95° \le \beta 1 \le 105°,$$

$$35° \le \beta 2 \le 45°$$

wherein B is a height of the blade, L is a length of a chord of the blade, β1 is an inlet angle of an inlet end of the blade closer to a rotational center of the sirocco fan, and β2 is an outlet angle of an outlet end of the blade farther from the rotational center of the sirocco fan.

Each of the plurality of blade may satisfy a following formula:

$$4.5 \leq d/L \leq 5.5$$

where d is an inner diameter of the sirocco fan.

According to another aspect of the present disclosure, a scroll for an air conditioner may include a scroll body comprising an inlet through which air is introduced, an outlet through which the air is discharged, and an air passage between the inlet and the outlet; a sirocco fan rotatably disposed in the scroll body, the sirocco fan configured to allow the air to be introduced through the inlet and to be discharged through the outlet when the sirocco fan rotates; and a bell mouth formed around the inlet of the scroll body, wherein the scroll body and the sirocco fan are formed to satisfy a following formula:

$$0.76 \leq D/H \leq 0.8$$

where H (mm) is a height of the scroll body, and D (mm) is an outer diameter of the sirocco fan, and wherein the bell mouth is formed in a two-step structure extending from a side wall of the scroll body to an inside of the scroll body, the bell mouth comprises two inclined portions and one flat portion, and inner diameters of the two inclined portions are formed to be smaller toward the inside of the scroll body.

According to another aspect of the present disclosure, an air conditioner may include a heat exchanger; and a scroll for the air conditioner disposed to blow the air toward the heat exchanger, the scroll having any one of the above described features.

Other objects, advantages and salient features of the present disclosure will become apparent from the following detailed description, which, taken in conjunction with the annexed drawings, discloses preferred embodiments.

BRIEF DESCRIPTION OF THE DRAWINGS

These and/or other aspects and advantages of the present disclosure will become apparent and more readily appreciated from the following description of embodiments, taken in conjunction with the accompanying drawings of which.

Throughout the drawings, like reference numerals will be understood to refer to like parts, components and structures.

DETAILED DESCRIPTION

Hereinafter, exemplary embodiments of the present disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

The terms used in the present application are only used to describe the exemplary embodiments, but are not intended to limit the scope of the disclosure. The singular expression also includes the plural meaning as long as it does not differently mean in the context. In the present application, the terms "include" and "consist of" designate the presence of features, numbers, steps, operations, components, elements, or a combination thereof that are written in the specification, but do not exclude the presence or possibility of addition of one or more other features, numbers, steps, operations, components, elements, or a combination thereof.

Figure 3:
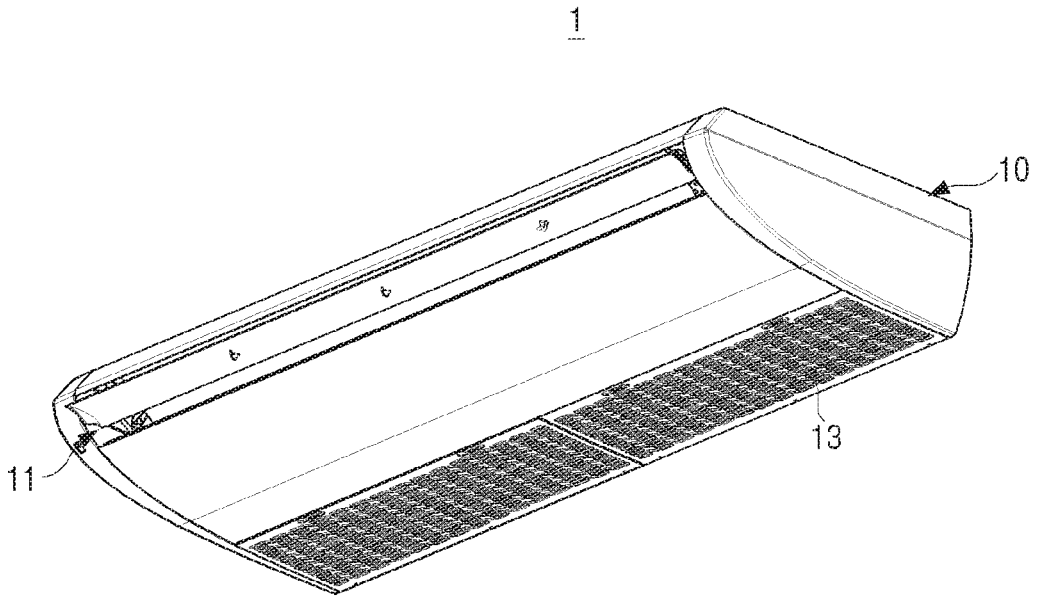
FIG. 3 is a perspective view illustrating an air conditioner according to an embodiment of the present disclosure.
Figure 4:
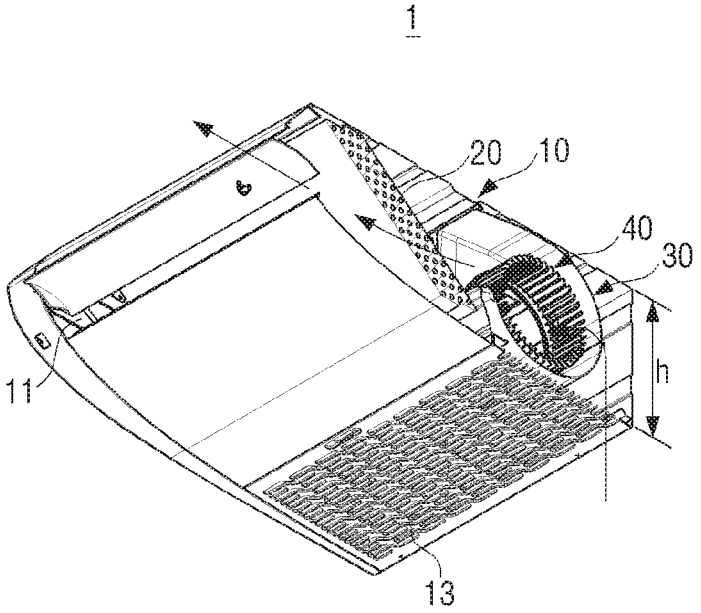
FIG. 4 is a cross-sectional perspective view illustrating the air conditioner of FIG. 3.

FIG. 3 is a perspective view illustrating an air conditioner according to an embodiment of the present disclosure. FIG. 4 is a cross-sectional perspective view illustrating the air conditioner of FIG. 3.

Referring to FIGS. 3 and 4, an air conditioner 1 according to an embodiment of the present disclosure may include a cabinet 10, a heat exchanger 20, and a scroll 30.

In FIGS. 3 and 4, the air conditioner 1 illustrates only an indoor unit. Although not illustrated, the air conditioner 1 may include an outdoor unit. The outdoor unit may include a compressor and a condenser, and is the same as or similar to a conventional outdoor unit. Therefore, a detailed description of the outdoor unit will be omitted. The air conditioner 1 according to an embodiment of the present disclosure may be disposed in a ceiling of a room or on a floor adjacent to one side wall of the room.

The cabinet 10 forms an outer appearance of the indoor unit of the air conditioner 1, and is provided with a discharge port 11 formed to discharge air in one side surface of the cabinet 10. The cabinet 10 is formed in a substantially rectangular parallelepiped shape, and fixes and supports the heat exchanger 20 and the scroll 30. The cabinet 10 is provided with an air inlet grill 13 in a bottom surface of the cabinet 10.

The heat exchanger 20 is disposed adjacent to the discharge port 11 inside the cabinet 10. Refrigerant that has low temperature and low pressure and is in a liquid state flows inside the heat exchanger 20. Accordingly, when hot air passes through the heat exchanger 20, the hot air is deprived of heat by the refrigerant so as to become cold air. In order to make the thickness of the indoor unit 1 thin, the whole shape of the heat exchanger 20 may be formed in a thin plate shape, and may be disposed obliquely with respect to the discharge port 11.

The scroll 30 sucks the external air and discharges the sucked air to the heat exchanger 20. The scroll 30 is disposed such that an outlet of the scroll 30 faces the discharge port 11. The air introduced through the air inlet grill 13 of the cabinet 10 enters the scroll 30. At least one scroll 30 may be used depending on the capacity of the air conditioner 1. In general, three or four scrolls 30 may be used. When a plurality of scrolls 30 are to be used, the plurality of scrolls 30 are disposed in a straight line parallel to the discharge port 11.

Hereinafter, the scroll 30 for an air conditioner 1 according to an embodiment of the present disclosure will be described with reference to FIGS. 5 to 10.

Figure 5:
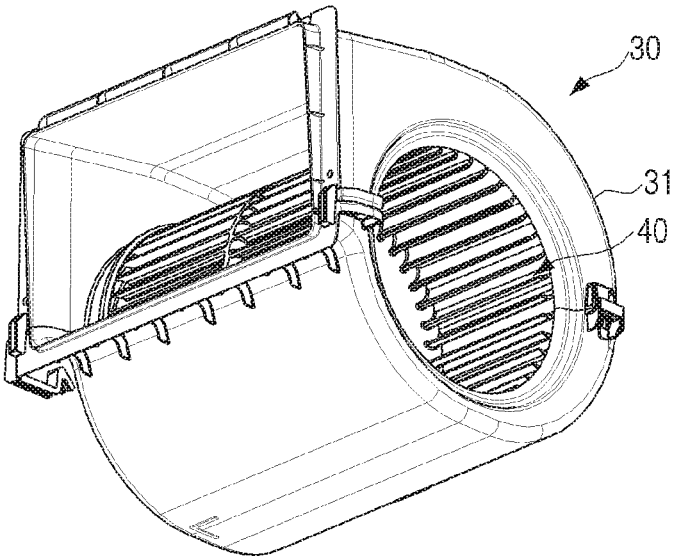
FIG. 5 is a perspective view illustrating a scroll that may be used in an air conditioner according to an embodiment of the present disclosure.
Figure 6:
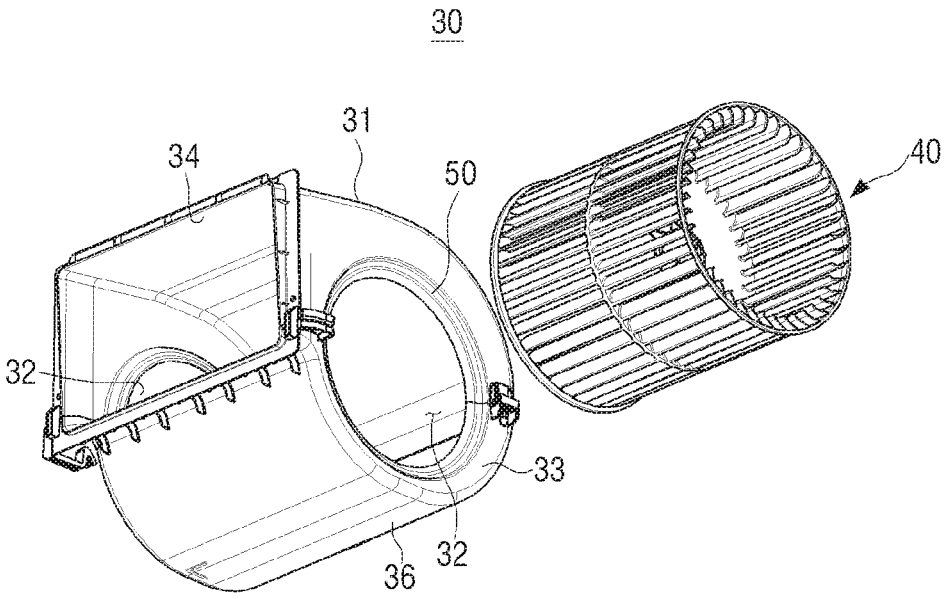
FIG. 6 is an exploded perspective view illustrating the scroll of FIG. 5.
Figure 7:
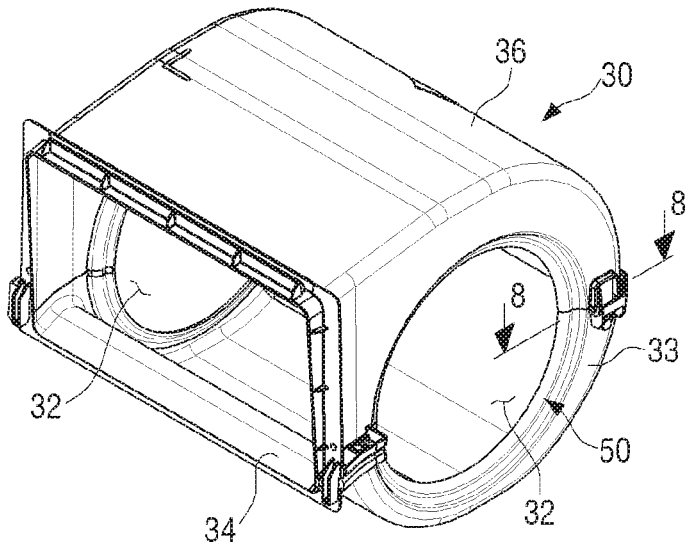
FIG. 7 is a perspective view illustrating a scroll body of a scroll for an air conditioner according to an embodiment of the present disclosure.
Figure 8:
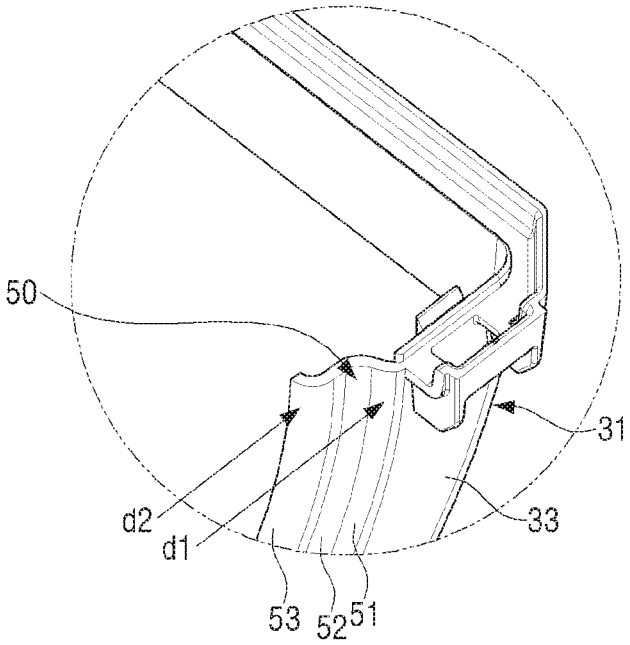
FIG. 8 is a partial cross-sectional view illustrating a bell mouth of the scroll body taken along a line 8-8 in FIG. 7.
Figure 9:
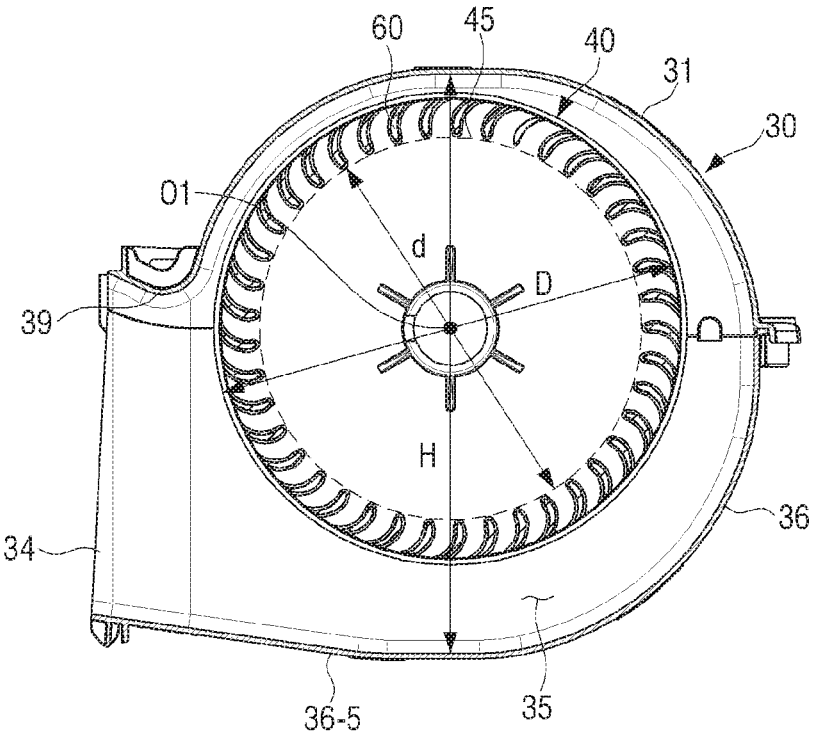
FIG. 9 is a cross-sectional view illustrating a state in which a sirocco fan is assembled in a scroll body of a scroll for an air conditioner according to an embodiment of the present disclosure.
Figure 10:
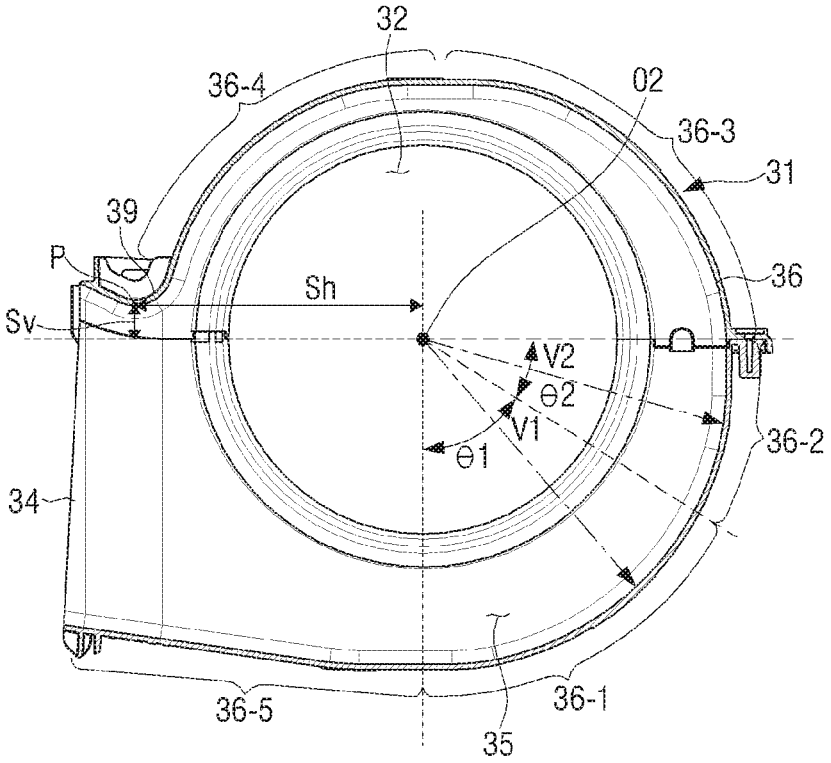
FIG. 10 is a cross-sectional view illustrating a scroll body of a scroll for an air conditioner according to an embodiment of the present disclosure.

FIG. 5 is a perspective view illustrating a scroll that may be used in an air conditioner according to an embodiment of the present disclosure, and FIG. 6 is an exploded perspective view illustrating the scroll of FIG. 5. FIG. 7 is a perspective view illustrating a scroll body of a scroll for an air conditioner according to an embodiment of the present disclosure. FIG. 8 is a partial cross-sectional view illustrating a bell mouth of the scroll body taken along a line 8-8 in FIG. 7. FIG. 9 is a cross-sectional view illustrating a state in which a sirocco fan is assembled in a scroll body of a scroll for an air conditioner according to an embodiment of the present disclosure. FIG. 10 is a cross-sectional view illustrating a scroll body of a scroll for an air conditioner according to an embodiment of the present disclosure.

The scroll 30 for the air conditioner according to an embodiment of the present disclosure includes a scroll body 31 and a sirocco fan 40.

The scroll body 31 accommodates the sirocco fan 40 and forms an air passage 35 therein. The scroll body 31 includes an inlet 32 that is formed concentrically with a rotational center O1 of the sirocco fan 40 and through which the air is introduced, an outlet 34 that discharges the air introduced through the inlet 32 toward the heat exchanger 20, and the air passage 35 that surrounds the sirocco fan 40, is formed in a curved shape, and allows the inlet 32 to be in communication with the outlet 34. The two inlets 32 are formed concentrically in the opposite side walls 33 of the scroll body 31.

A bell mouth 50 may be formed in the inlet 32 of the scroll body 31 in order to stabilize the air being introduced through the inlet 32. The opposite side walls 33 of the scroll body 31 are connected to a circumferential surface 36 forming the air passage 35. The circumferential surface 36 may be formed in a shape connecting a plurality of curved surfaces rather than a circular cross-section. The plurality of curved surfaces may be formed such that a radius of each of the plurality of curved surfaces is increased toward the outlet 34.

The sirocco fan 40 is rotatably disposed inside the scroll body 31, and when the sirocco fan 40 rotates, the air in the atmospheric pressure is sucked into the inlet 32 of the scroll body 31, becomes the air flow of the high-pressure, and then is discharged through the outlet 34. In detail, the sirocco fan 40 is formed in a cylindrical shape, and has a plurality of thin and long blades 60 arranged on the circumference. The sirocco fan 40 is formed to be rotated by a motor (not illustrated) disposed at one side of the sirocco fan 40. When the sirocco fan 40 is rotated, the external air is introduced into the inside of the sirocco fan 40 through the inlet 32 of the scroll body 31, and then is discharged toward the outlet 34 of the scroll body 31 through space between the plurality of blades 60.

In order to improve the blowing air performance of the sirocco fan 40, for example, the blowing air volume, a diameter D (see FIG. 9) of the sirocco fan 40 may be increased. The larger the diameter of the sirocco fan 40 is, the larger the size of the scroll 30 accommodating the sirocco fan 40 is. Therefore, the height h (see FIG. 4) of the cabinet 10 is increased. However, because there is a limit to the height h of the air conditioner 1 disposed in the ceiling, the height h of the cabinet 10 may not be increased as desired. Accordingly, in a state in which the height h of the cabinet 10 is fixed, it is necessary to determine the shape of the scroll 30 to maximize the blowing air performance of the sirocco fan 40 depending on the diameter D of the sirocco fan 40.

When the height of the scroll body 31 and the outer diameter of the sirocco fan 40 satisfy a following condition, the blowing air performance of the sirocco fan 40 is improved.

$$0.76 \leq D/H \leq 0.8$$

Here, H (mm) is the height of the scroll body 31, and D (mm) is the outer diameter of the sirocco fan 40. The height H of the scroll body 31 refers to the height of the highest point in the scroll body 31 when the scroll 30 is disposed in the cabinet 10 as illustrated in FIG. 4. In detail, as illustrated in FIG. 9, the height H of the scroll body 31 is the height from a bottom surface 36-5 of the scroll body 31 extending from the outlet 34 to a top end of the scroll body 31 measured on a vertical line passing through the rotational center O1 of the sirocco fan 40. Accordingly, the height H of the scroll body 31 is the same as the height of the scroll 30.

Figure 12:
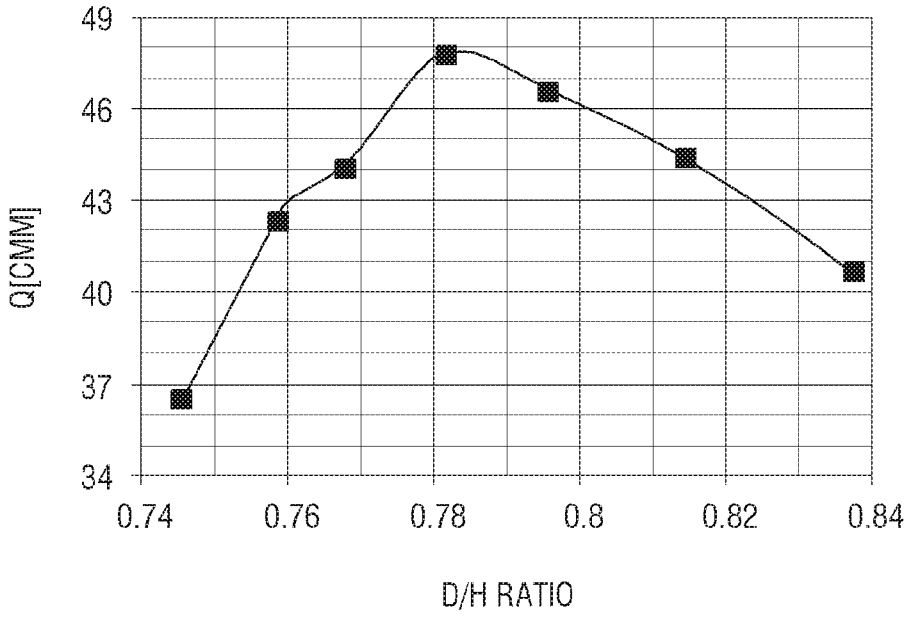
FIG. 12 is a graph illustrating a performance test result according to ratios of a diameter of a sirocco fan to a height of a scroll in a scroll for an air conditioner according to an embodiment of the present disclosure.

A test result of the blowing air volume of the sirocco fan 40 in accordance with the ratio of the outer diameter D of the sirocco fan 40 to the height H of the scroll body 31 is shown in FIG. 12.

FIG. 12 is a graph illustrating a performance test result according to the ratio of the outer diameter D of the sirocco fan 40 to the height H of the scroll body 31 in the scroll 30 for an air conditioner according to an embodiment of the present disclosure.

Referring to FIG. 12, it may be seen that the blowing air volume is maximum where the ratio of the outer diameter D of the sirocco fan 40 to the height H of the scroll body 31 is near 0.78.

Also, the blowing air performance of the sirocco fan 40 may be improved by determining a position relationship between a cutoff 39, which is formed on an upper surface of the outlet 34 of the scroll body 31, and the center O2 of the inlet 32 as follows. The cutoff 39 is formed in a curved surface shape projecting from the upper surface of the outlet 34 toward a lower surface of the outlet 34.

$$0.13 \leq Sv/Sh \leq 0.15$$

Here, Sv represents a vertical distance from an imaginary horizontal extension line of the center O2 of the inlet 32 of the scroll body 31 to the apex P of the cutoff 39. Sh represents a horizontal distance from an imaginary vertical extension line of the center O2 of the inlet 32 of the scroll body 31 to the apex P of the cutoff 39. The imaginary horizontal extension line and the imaginary vertical extension line are perpendicular to each other. Here, the apex P of the cutoff 39 refers to the highest point on the cutoff 39 of the curved surface projecting from the upper surface of the outlet 34.

At this time, since the center O2 of the inlet 32 of the scroll body 31 is approximately the same location as the rotational center O1 of the sirocco fan 40, the apex P of the cutoff 39 of the scroll body 31 may have the above-described position relationship with respect to the rotational center O1 of the sirocco fan 40.

Also, if the circumferential surface 36 of the scroll body 31 forming the air passage 35 is formed to satisfy a condition as follows, the blowing air performance of the sirocco fan 40 may be improved.

$$0.7 \leq V2/V1 \leq 0.75$$

Here, V1 represents a radius from the center O2 of the inlet 32 of the scroll body 31 to a first circumferential surface 36-1 of the scroll body 31, and V2 represents a radius from the center O2 of the inlet 32 of the scroll body 31 to a second circumferential surface 6-2 of the scroll body 31.

At this time, one end of the first circumferential surface 36-1 is connected to a bottom surface 36-5 of the outlet 34, and the other end of the first circumferential surface 36-1 is connected to the second circumferential surface 36-2. The radius V1 of the first circumferential surface 36-1 is formed to be larger than the radius V2 of the second circumferential surface 36-2. The first circumferential surface 36-1 may be formed of a length corresponding to approximately 70 degrees θ1 of a subtended angle at the center O2 of the inlet 32 of the scroll body 31.

One end of the second circumferential surface 36-2 is connected to the first circumferential surface 36-1, and the other end of the second circumferential surface 36-2 is connected to a third circumferential surface 36-3. The second circumferential surface 36-2 may be formed of a length corresponding to approximately 20 degrees θ2 of a subtended angle at the center O2 of the inlet 32 of the scroll body 31.

The third circumferential surface 36-3 is formed to have a radius smaller than the second circumferential surface 36-2. One end of the third circumferential surface 36-3 is connected to the second circumferential surface 36-2, and the other end of the third circumferential surface 36-3 is connected to a fourth circumferential surface 36-4.

One end of the fourth circumferential surface 36-4 is connected to the third circumferential surface 36-3, and the other end of the fourth circumferential surface 36-4 is connected to the cutoff 39. The fourth circumferential surface 36-4 is formed to have a radius smaller than the third circumferential surface 36-3.

Accordingly, the plurality of curved surfaces configuring the circumferential surface 36 of the scroll body 31, for example, the first circumferential surface 36-1, the second circumferential surface 36-2, the third circumferential surface 36-3, and the fourth circumferential surface 36-4 are formed to have a radius getting bigger from the fourth circumferential surface 36-4 toward the first circumferential surface 36-1.

In the present embodiment, the circumferential surface 36 of the scroll body 31 is formed of four curved surfaces 36-1, 36-2, 36-3, and 36-4 having different radii. However, the number of the curved surfaces forming the circumferential surface 36 is not limited thereto. The number of the curved surfaces forming the circumferential surface 36 may be five or more.

Also, the blowing air performance of the sirocco fan 40 may be improved by stabilizing the flow of the air entering the sirocco fan 40 through the inlet 32 of the scroll body 31. For this, the bell mouth formed in the inlet of the scroll body may be formed in a multi-step structure. For example, the bell mouth 50 formed in the inlet 32 of the scroll body 31 may be formed in a two-step structure as illustrated in FIGS. 7 and 8.

In detail, the bell mouth 50 is formed in a shape extending inwardly from the side wall 33 of the scroll body 31, and is formed in the two-step structure. The two-step structure of the bell mouth 50 is formed so that the inner diameters of the bell mouth 50 are getting smaller toward the inside of the scroll body 31.

For example, the bell mouth 50 includes a first inclined portion 51 which is bent inwardly extending from the side wall 33 of the scroll body 31, a flat portion 52 which is bent substantially parallel to the side wall 33 of the scroll body 31 and extends from the first inclined portion 51, and a second inclined portion 53 which is bent inwardly extending from the flat portion 52.

The inner diameter d1 of the first inclined portion 51 is formed to be larger than the inner diameter d2 of the second inclined portion 53. Also, the flat portion 52 is formed to be inwardly lower than the side wall 33 of the scroll body 31. The first inclined portion 51, the flat portion 52, and the second inclined portion 53 configuring the bell mouth 50 may be formed to be connected to one another by a curved surface.

If the bell mouth 50 is formed in the two-step structure, the air suction area of the inlet 32 may be widened in comparison with the inlet having the conventional bell mouth of a round shape. Accordingly, because the air introduced from the outside to the inlet 32 of the scroll body 31 moves along the bell mouth 50 bent in the two-step structure, a constant pressure distribution may be achieved.

Figure 11:
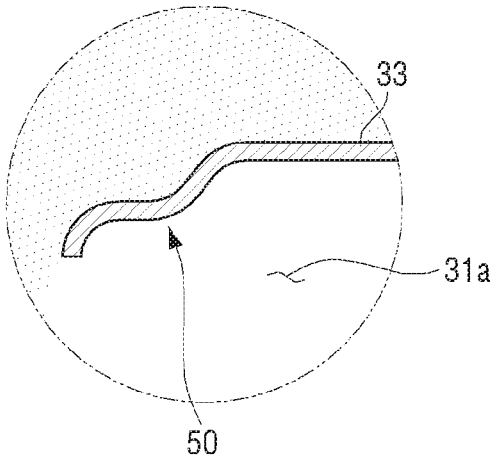
FIG. 11 is a view illustrating a result obtained by analyzing a suction flow of air introduced into the bell mouth of FIG. 8.

FIG. 11 is a view illustrating a result obtained by analyzing a suction flow of air introduced into the bell mouth 50 having the above-described structure.

Figure 1:
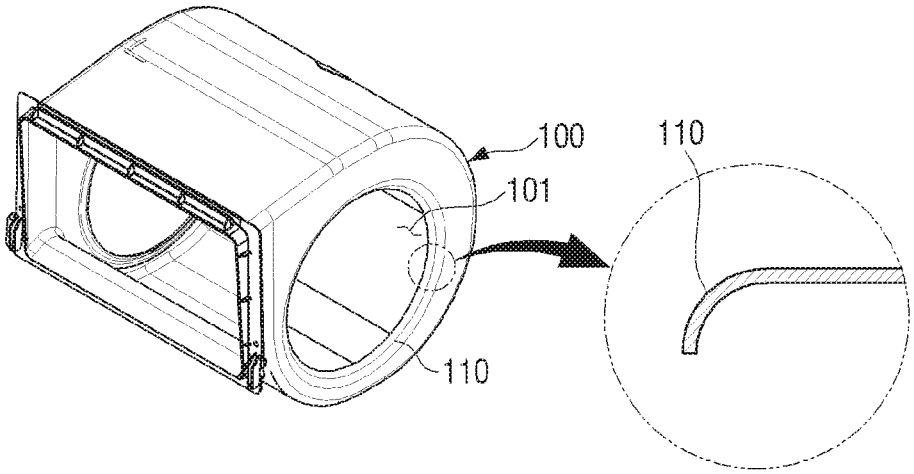
FIG. 1 (RELATED ART)
FIG. 1 is a perspective view illustrating a conventional scroll.
Figure 2:
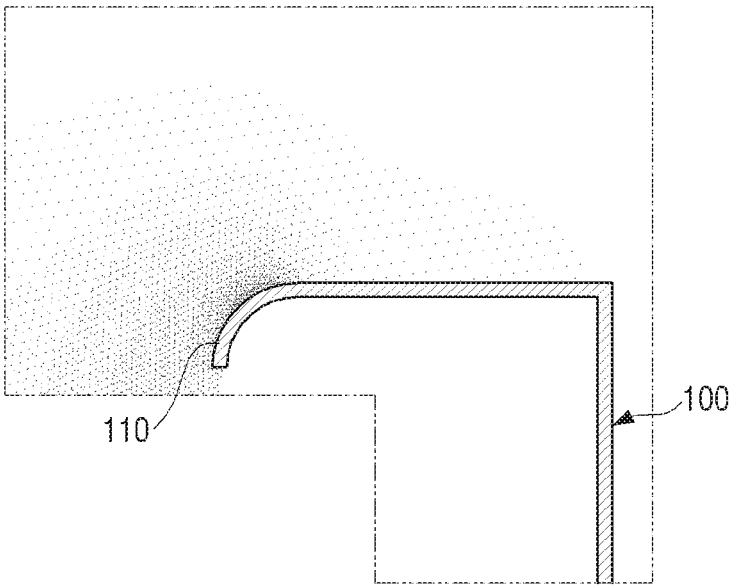
FIG. 2 (RELATED ART)
FIG. 2 is a view illustrating a result obtained by analyzing a suction flow of air introduced into a bell mouth of the conventional scroll of FIG. 1.

Referring to FIG. 11, it may be seen that the pressure distribution in the bell mouth 50 of the scroll body 31 according to an embodiment of the present disclosure is uniform unlike the conventional bell mouth as illustrated in FIG. 2. Accordingly, if the bell mouth 50 is formed in the two-step structure as the present disclosure, the pressure distribution of the air entering the scroll body 31 is uniform so that the suction flow of the air is stabilized. As a result, the blowing efficiency of the sirocco fan 40 also may be improved. In FIG. 11, a reference number 31*a* represents a space of the inside of the scroll body 31.

Further, in order to improve the blowing air performance of the sirocco fan 40, a shape of each of the plurality of blades 60 constituting the sirocco fan 40 may be changed. The shape change of the blades of the sirocco fan 40 will be described in detail with reference to FIGS. 13 to 15.

Figure 13:
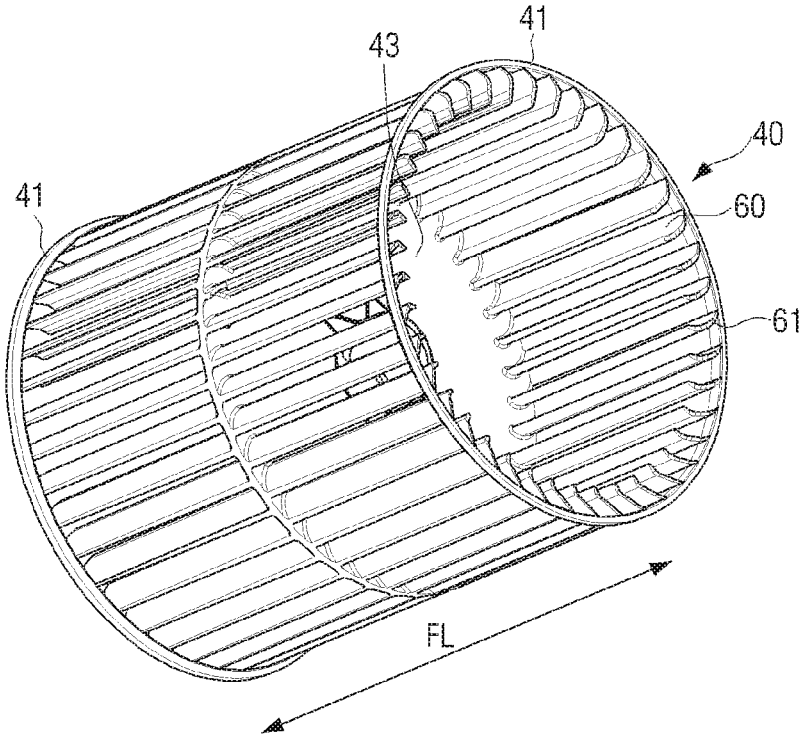
FIG. 13 is a perspective view illustrating a sirocco fan according to an embodiment of the present disclosure.
Figure 14:
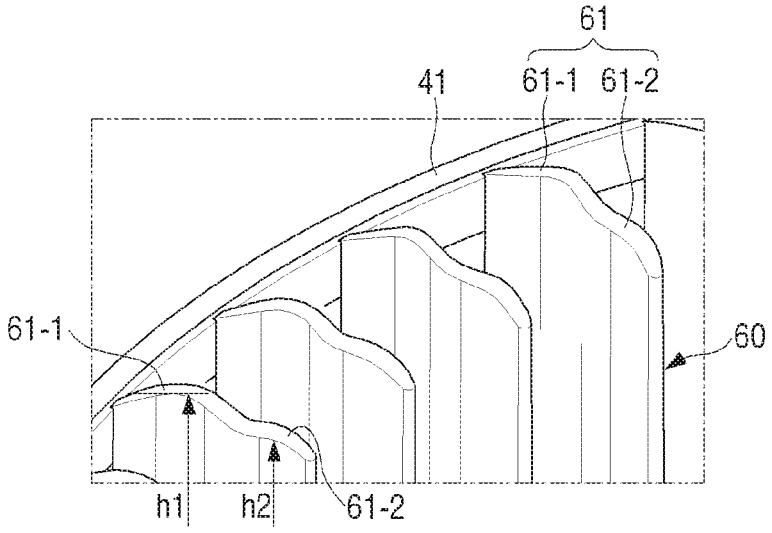
FIG. 14 is a partial perspective view illustrating an end portion of a sirocco fan according to an embodiment of the present disclosure.
Figure 15:
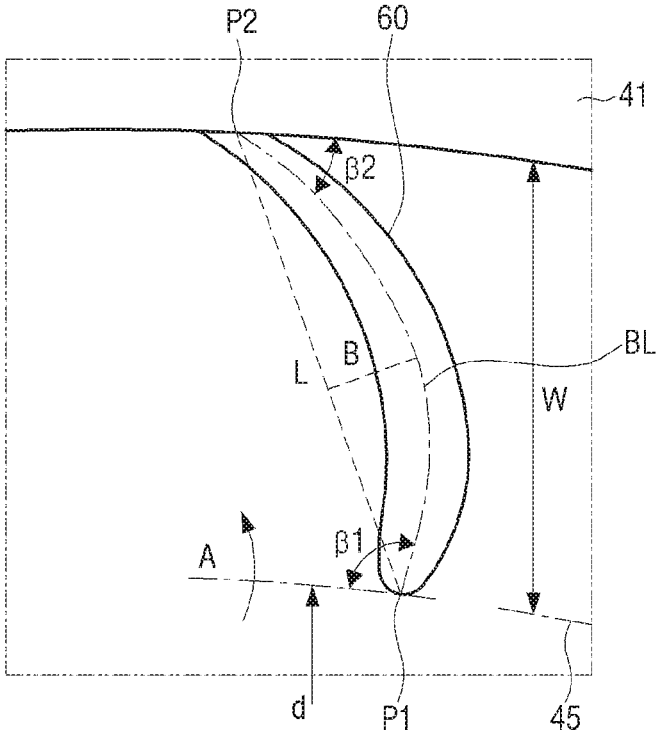
FIG. 15 is a plan view illustrating a blade of a sirocco fan according to an embodiment of the present disclosure.

FIG. 13 is a perspective view illustrating a sirocco fan according to an embodiment of the present disclosure. FIG. 14 is a partial perspective view illustrating an inflow end portion of a sirocco fan according to an embodiment of the present disclosure. FIG. 15 is a plan view illustrating a blade of a sirocco fan according to an embodiment of the present disclosure.

The present disclosure may be applied to a double suction sirocco fan 40 through the opposite side walls of which the air is introduced as illustrated in FIG. 13.

Referring to FIG. 13, the double suction sirocco fan 40 is provided with a hub 43 in the middle thereof, and is provided with a pair of rings 41 in the opposite ends thereof. A plurality of blades 60 are arranged at a predetermined interval between the hub 43 and the pair of rings 41. Accordingly, the air being introduced into the inlet 32 of the scroll body 31 enters the inside of the sirocco fan 40, and then is discharged through spaces between the plurality of blades 60. The center of the hub 43 is connected to a shaft of a motor (not illustrated) so that, when the motor rotates, the sirocco fan 40 is rotated.

In the conventional sirocco fan, an end portion of each of the plurality of blades connected to the ring is formed to have the same height. In other words, the blade is formed to have the same length with respect to the entire width of the blade. However, if the end portion of the blade is formed to have the same height as described above, an eddy current is generated near the ring adjacent to the bell mouth, thereby increasing noise of the sirocco fan and degrading the blowing air performance of the sirocco fan.

In order to solve this problem, the blades for the sirocco fan may have different shapes. For example, an end portion of blades may have different heights or shapes. In the sirocco fan 40 according to an embodiment of the present disclosure, the end portion 61 of the blade 60 is formed in two steps. In detail, as illustrated in FIG. 14, the end portion 61 of the blade 60 is formed in a step shape so that a height h1 of a first end portion 61-1 close to the ring 41 is different from a height h2 of a second end portion 61-2 adjacent to the rotational center O1 of the sirocco fan 40. At this time, the height h1 of the first end portion 61-1 is formed to be higher than the height h2 of the second end portion 61-2, and the first end portion 61-1 is connected to the second end portion 61-2 by a curved surface. Here, the height h1 of the first end portion 61-1 refers to the length of the blade 60 from the hub 43 to the first end portion 61-1, and the height h2 of the second end portion 61-2 refers to the length of the blade 60 from the hub 43 to the second end portion 61-2. At this time, the height difference (h1−h2) between the first end portion 61-1 and the second end portion 61-2, that is, the height of the step may be approximately 5% of the length of the blade 60.

If the end portion 61 of the blade 60 is formed in the two-step structure as described above, the flow field of air is generated in the vicinity of the ring 41 of the sirocco fan 40, thereby improving the efficiency of the sirocco fan 40.

Figure 16:
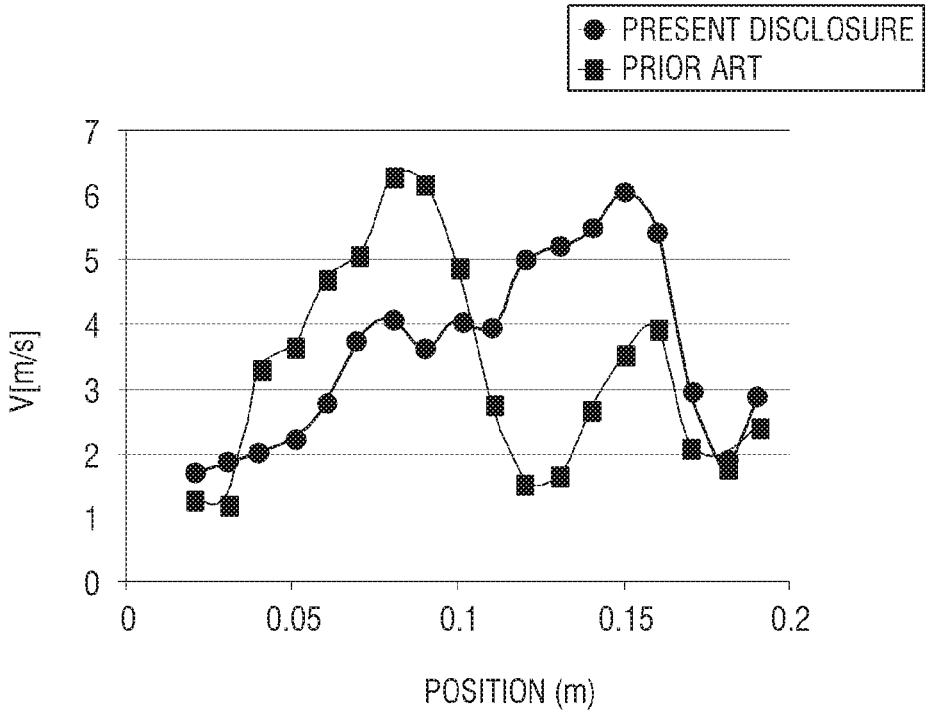
FIG. 16 is a graph comparing flow rate distribution at a rear end of a conventional sirocco fan and of a sirocco fan according to an embodiment of the present disclosure.

A graph comparing the blowing air performance of the sirocco fan 40 having the blades 60 according to an embodiment of the present disclosure to that of a sirocco fan having the conventional blades is shown in FIG. 16.

FIG. 16 is a graph comparing flow velocity distribution at a rear end of a conventional sirocco fan and of a sirocco fan according to an embodiment of the present disclosure.

In FIG. 16, the position represents locations in which flow rates are measured in the entire length FL of the sirocco fan 40 (see FIG. 13). The graph of FIG. 16 shows the flow rates measured in 18 locations of the entire length FL of the sirocco fan 40 used for the measurement.

Referring to FIG. 16, in the case of the conventional sirocco fan, the flow rate is fast in the vicinity of the hub in the middle of the sirocco fan, and variation in the flow rate is very large along the length of the sirocco fan. However, the sirocco fan 40 according to an embodiment of the present disclosure has a more uniform flow rate over the entire length than the conventional sirocco fan. Accordingly, it may be seen that the flow rate distribution of the sirocco fan 40 provided with blades 60 having the end portion 61 of the two-step structure according to an embodiment of the present disclosure is improved in comparison with the conventional sirocco fan provided with blades having the end portion of the same height. If it is calculated in figures, improved results of about 12.6% may be obtained.

Further, in order to reduce noise and power consumption of the sirocco fan 40, the shape of the blade 60 may be improved.

Referring to FIG. 15, the blade 60 is formed in a streamline shape curved at a predetermined curvature. The air flowing into the scroll body 31 is discharged to the outside along the blade 60 from the inside of the sirocco fan 40. Accordingly, as illustrated in FIG. 15, the air moves along the blade 60 in a direction of arrow A. Accordingly, an inlet end P1 of the blade 60 is closer to the rotational center O1 of the sirocco fan 40, and an outlet end P2 of the blade 60 is farther from the rotational center O1 of the sirocco fan 40 and is connected to the ring 40.

The shape of the blade 60 may vary depending on an inlet angle, an outlet angle, and a height of the blade 60. Here, the inlet angle of the blade 60 refers to an angle between a circle 45 connecting the inlet ends P1 of the plurality of blades 60 and a center line BL of the blade 60. The outlet angle of the blade 60 refers to an angle between the ring 41 connecting the outlet ends P2 of the plurality of blades 60 and the center line BL of the blade 60. Also, when a straight line connecting the inlet end P1 and the outlet end P2 of the blade 60 is referred to as a chord L of the blade 60, the height B of the curved blade 60 may be measured based on the chord L of the blade 60. Accordingly, the height B of the blade 60 is defined as the height of a point of the center line BL of the blade 60 that is highest from the chord L of the blade 60.

If the shape of the blade 60 is formed as a follow condition, the noise of the sirocco fan 40 may be reduced, and the power consumption may be reduced so that the efficiency of the sirocco fan 40 is increased.

$$0.17 \le B/L \le 0.2$$

$$95° \le \beta 1 \le 105°$$

$$35° \le \beta 2 \le 45°$$

Here, B represents a height of the blade 60, L represents a length of the chord of the blade 60, β1 represents an inlet angle of the blade 60, and β2 represents an outlet angle of the blade 60.

Also, the arrangement of the plurality of blades 60 may be changed by adjusting the ratio of the chord L of the blade 60 to the inner diameter d of the sirocco fan 40. Accordingly, if the ratio of the chord L of the blade 60 to the inner diameter d of the sirocco fan 40 is determined in the following range, it is possible to reduce noise and power consumption of the sirocco fan 40.

$$4.5 \leq d/L \leq 5.5$$

Here, d represents the inner diameter of the sirocco fan 40, and L presents the length of the chord of the blade 60. The inner diameter of the sirocco fan 40 refers to the diameter of the circle 45 connecting the inlet ends P1 of the plurality of blades 60.

Figure 17:
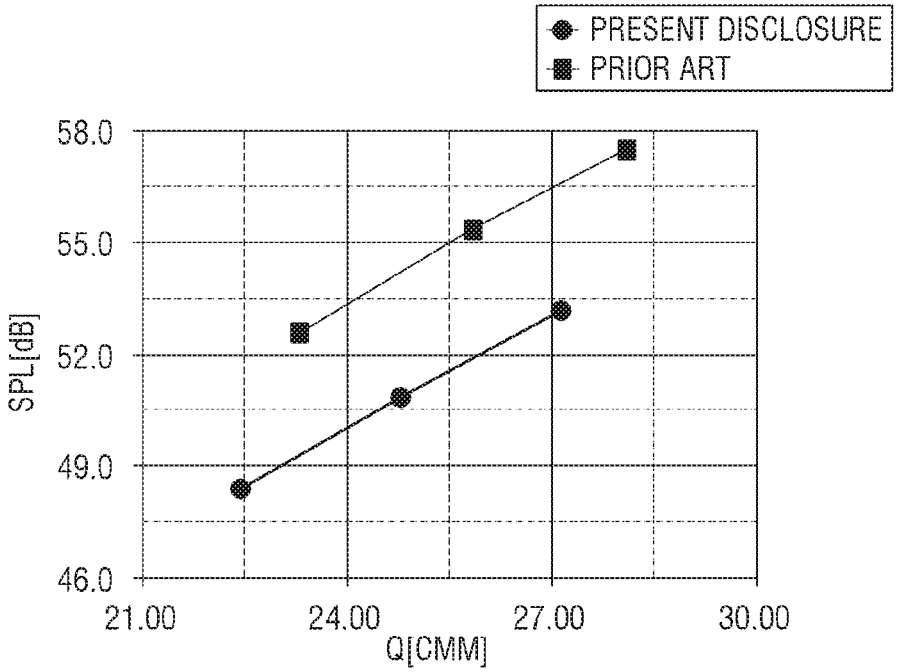
FIG. 17 is a graph comparing sound pressure levels according to inlet and outlet angles of a blade of a conventional sirocco fan and of a blade of a sirocco fan according to an embodiment of the present disclosure.
Figure 18:
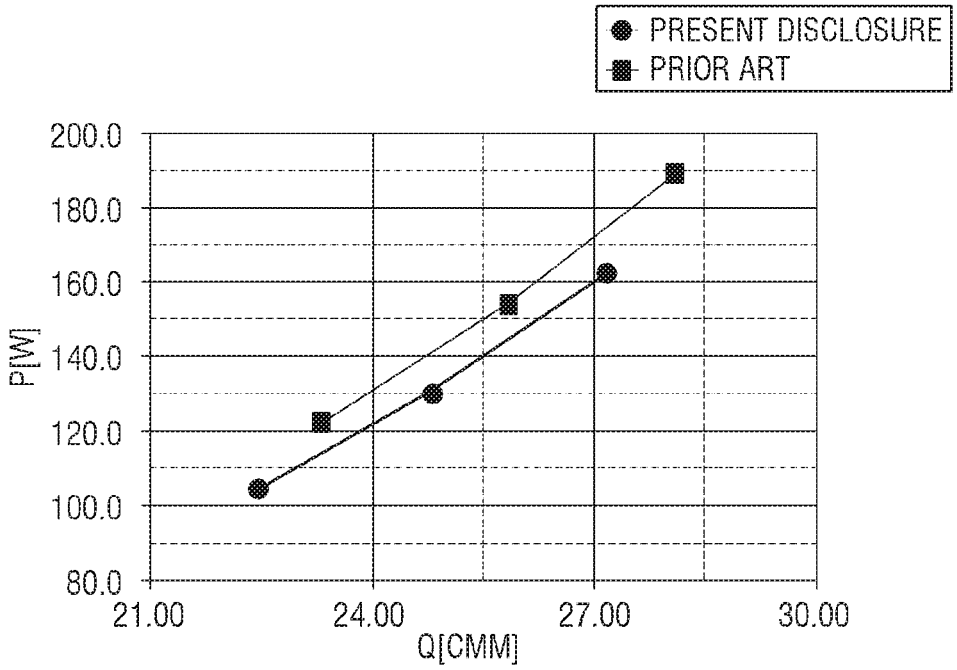
FIG. 18 is a graph comparing power consumption according to inlet and outlet angles of a blade of a conventional sirocco fan and of a blade of a sirocco fan according to an embodiment of the present disclosure.

Graphs comparing noise and power consumption of the sirocco fan 40 having the blades 60 according to an embodiment of the present disclosure to those of a sirocco fan having the conventional blades are shown in FIGS. 17 and 18.

FIG. 17 is a graph comparing sound pressure levels according to inlet and outlet angles of a blade of a conventional sirocco fan and of a blade 60 of a sirocco fan 40 according to an embodiment of the present disclosure, and FIG. 18 is a graph comparing power consumption according to inlet and outlet angles of a blade of a conventional sirocco fan and of a blade 60 of a sirocco fan 40 according to an embodiment of the present disclosure.

The graphs of FIGS. 17 and 18 show the result measured in a state in which the inlet angle and the outlet angle of the blade 60 of the sirocco fan 40 are defined as the following table. At this time, the other dimensions of the blade 60 are maintained in the same values.

| | Conventional blade | Blade according to a present disclosure |
|---|---|---|
| Inlet angle β1 | 93° | 98° |
| Outlet angle β2 | 21° | 37° |

Referring to FIG. 17, it may be seen that the sound pressure level SPL of the conventional sirocco fan is higher than that of the sirocco fan 40 according to an embodiment of the present disclosure. It may be seen from FIG. 17 that the sound pressure level SPL of the sirocco fan 40 according to an embodiment of the present disclosure is decreased about 3.5 dB than that of the conventional sirocco fan.

Also, referring to FIG. 18, it may be seen that the power consumption P of the sirocco fan 40 according to an embodiment of the present disclosure is smaller than that of the conventional sirocco fan. It may be seen from FIG. 18 that the power consumption P of the sirocco fan 40 according to an embodiment of the present disclosure is decreased about 10 W than that of the conventional sirocco fan.

As described above, with the sirocco fan 40 according to an embodiment of the present disclosure, the blowing air performance may be improved, and noise and power consumption may be reduced.

While embodiments of the present disclosure have been described, additional variations and modifications of the embodiments may occur to those skilled in the art once they learn of the basic inventive concepts. Therefore, it is intended that the appended claims shall be construed to include both above embodiments and all such variations and modifications that fall within the spirit and scope of the inventive concepts.

What is claimed is:

1. A scroll for an air conditioner comprising:

a scroll body comprising an inlet through which air is introduced into the scroll, an outlet through which the introduced air is discharged from the scroll, and an air passage formed between the inlet and the outlet; and a sirocco fan rotatably disposed in the scroll body so that when the sirocco fan operates, the sirocco fan introduces the air into the scroll through the inlet and discharges the introduced air from the scroll through the outlet, wherein the scroll body and the sirocco fan satisfy a following formula:

$$0.76 \leq D/H \leq 0.8$$

where H (mm) is a height of the scroll body from a bottom surface of the scroll body extending from the outlet to a top end of the scroll body measured on a vertical line passing through the rotational center of the sirocco fan and D (mm) is an outer diameter of the sirocco fan.

2. The scroll of claim 1, further comprising a bell mouth formed around the inlet of the scroll body, wherein the bell mouth is formed in a multi-step structure extending from a side wall of the scroll body to an inside of the scroll body so that inner diameters of the bell mouth are smaller toward the inside of the scroll body.

3. The scroll of claim 2, wherein the bell mouth comprises:

a first inclined portion which is bent inwardly extending from the side wall of the scroll body;

a flat portion which is bent substantially parallel to the side wall of the scroll body and extends from the first inclined portion; and a second inclined portion which is bent inwardly extending from the flat portion, wherein the first inclined portion and the flat portions form at least partially the multi-step structure.

4. The scroll of claim 1, wherein a cutoff is formed in an upper surface of the outlet of the scroll body, and the cutoff is formed in a position to satisfy a following formula:

$$0.13 \leq Sv/Sh \leq 0.15$$

wherein Sv is a vertical distance from an imaginary horizontal extension line of a center of the inlet of the scroll body to an apex of the cutoff, and Sh is a horizontal distance from an imaginary vertical extension line of the center of the inlet of the scroll body to the apex of the cutoff, wherein the imaginary horizontal extension line and imaginary vertical line are perpendicular to each other.

5. The scroll of claim 4, wherein the scroll body comprises a circumferential surface formed of a plurality of curved surfaces whose radii from the center of the inlet of the scroll body are different, wherein the plurality of curved surfaces comprises a first circumferential surface connected to the outlet and a second circumferential surface connected to the first circumferential surface, and wherein the circumferential surface of the scroll body is formed to satisfy a following formula:

$$0.7 \leq V2/V1 \leq 0.75$$

where V1 is a radius from the center of the inlet of the scroll body to the first circumferential surface of the scroll body, and V2 is a radius from the center of the inlet of the scroll body to the second circumferential surface of the scroll body.

6. The scroll of claim 1, wherein
the sirocco fan comprises:
a plurality of rings to face each other; and
a plurality of blades disposed between the plurality of rings, and
wherein an end of each of the plurality of blades in contact with the plurality of rings is formed to have a step.

7. The scroll of claim 6, wherein
the step of the blade has a height of about 5% of a length of the blade.

8. The scroll of claim 1, wherein
the sirocco fan comprises:
a plurality of rings to face each other; and
a plurality of blades disposed between the plurality of rings, and
wherein each of the plurality of blades satisfies following formulas:

$$0.17 \leq B/L \leq 0.2$$

$$95° \leq \beta 1 \leq 105°$$

$$35° \leq \beta 2 \leq 45°$$

wherein B is a height of the blade, L is a length of a chord of the blade, β1 is an inlet angle of an inlet end of the blade closer to a rotational center of the sirocco fan, and β2 is an outlet angle of an outlet end of the blade farther from the rotational center of the sirocco fan.

9. The scroll of claim 8, wherein
each of the plurality of blade satisfies a following formula:

$$4.5 \leq d/L \leq 5.5$$

where d is an inner diameter of the sirocco fan.

10. A scroll for an air conditioner comprising:
a scroll body comprising an inlet through which air is introduced into the scroll, an outlet through which the introduced air is discharged from the scroll, and an air passage formed between the inlet and the outlet;
a sirocco fan rotatably disposed in the scroll body so that when the sirocco fan operates, the sirocco fan introduces the air into the scroll through the inlet and discharges the introduced air from the scroll through the outlet; and
a bell mouth formed around the inlet of the scroll body,
wherein the scroll body and the sirocco fan are formed to satisfy a following formula:

$$0.76 \leq D/H \leq 0.8$$

where H (mm) is a height of the scroll body from a bottom surface of the scroll body extending from the outlet to a top end of the scroll body measured on a vertical line passing through the rotational of the sirocco fan and D (mm) is an outer diameter of the sirocco fan, and
wherein the bell mouth is formed in a two-step structure extending from a side wall of the scroll body to an inside of the scroll body, the bell mouth comprises two inclined portions and one flat portion, and inner diameters of the two inclined portions are formed to be smaller toward the inside of the scroll body.

11. The scroll of claim 10, wherein
a cutoff is formed in an upper surface of the outlet of the scroll body, and
the cutoff is formed in a position to satisfy a following formula:

$$0.13 \leq Sv/Sh \leq 0.15$$

where Sv is a vertical distance from an imaginary horizontal extension line of a center of the inlet of the scroll body to an apex of the cutoff, and Sh is a horizontal distance from a imaginary vertical extension line of the center of the inlet of the scroll body to the apex of the cutoff,
wherein the imaginary horizontal extension line and imaginary vertical line are perpendicular to each other.

12. The scroll of claim 11, wherein
the scroll body comprises a circumferential surface formed of a plurality of curved surfaces whose radii from the center of the inlet of the scroll body are different,
the plurality of curved surfaces comprises a first circumferential surface connected to the outlet and a second circumferential surface connected to the first circumferential surface, and
the circumferential surface of the scroll body is formed to satisfy a following formula:

$$0.7 \leq V2/V1 \leq 0.75$$

where V1 is a radius from the center of the inlet of the scroll body to the first circumferential surface of the scroll body, and V2 is a radius from the center of the inlet of the scroll body to the second circumferential surface of the scroll body.

13. An air conditioner comprising:
a heat exchanger; and
a scroll for the air conditioner to blow the air toward the heat exchanger,
wherein the scroll for the air conditioner comprises
a scroll body comprising an inlet through which air is introduced into the scroll, an outlet through which the introduced air is discharged from the scroll, and an air passage formed between the inlet and the outlet; and
a sirocco fan rotatably disposed in the scroll body so that when the sirocco fan rotates, the sirocco fan introduces the air into the scroll through the inlet and discharges the introduced air from the scroll through the outlet, wherein the scroll body and the sirocco fan satisfy a following formula:

$$0.76 \leq D/H \leq 0.8$$

where H (mm) is a height of the scroll body from a bottom surface of the scroll body extending from the outlet to a top end of the scroll body measured on a vertical line passing through the rotational centre of the sirocco fan and D (mm) is an outer diameter of the sirocco fan.

14. The air conditioner of claim 13, further comprising a bell mouth formed around the inlet of the scroll body and wherein the bell mouth is formed in a multi-step structure extending from a side wall of the scroll body to an inside of the scroll body so that inner diameters of the bell mouth are smaller toward the inside of the scroll body.

15. The air conditioner of claim 14, wherein
the bell mouth comprises:
a first inclined portion which is bent inwardly extending from the side wall of the scroll body;
a flat portion which is bent substantially parallel to the side wall of the scroll body and extends from the first inclined portion; and
a second inclined portion which is bent inwardly extending from the flat portion,
wherein the first inclined portion and the flat portion form at least partially the multi-step structure.

16. The air conditioner of claim 13, wherein a cutoff is formed in an upper surface of the outlet of the scroll body, and the cutoff is formed in a position to satisfy a following formula:

$$0.13 \leq Sv/Sh \leq 0.15$$

where Sv is a vertical distance from an imaginary horizontal extension line of a center of the inlet of the scroll body to an apex of the cutoff, and Sh is a horizontal distance from an imaginary vertical extension line of the center of the inlet of the scroll body to the apex of the cutoff, wherein the imaginary horizontal extension line and imaginary vertical line are perpendicular to each other.

17. The air conditioner of claim 16, wherein the scroll body comprises a circumferential surface formed of a plurality of curved surfaces whose radii from the center of the inlet of the scroll body are different, wherein the plurality of curved surfaces comprises a first circumferential surface connected to the outlet and a second circumferential surface connected to the first circumferential surface, and wherein the circumferential surface of the scroll body is formed to satisfy a following formula:

$$0.7 \leq V2/V1 \leq 0.75$$

where V1 is a radius from the center of the inlet of the scroll body to the first circumferential surface of the scroll body, and V2 is a radius from the center of the inlet of the scroll body to the second circumferential surface of the scroll body.

18. The air conditioner of claim 13, wherein the sirocco fan comprises:

a plurality of rings to face each other; and a plurality of blades disposed between the plurality of rings, and wherein an end of each of the plurality of blades in contact with the plurality of rings is formed to have a step.

19. The air conditioner of claim 13, wherein the sirocco fan comprises:

a plurality of rings to face each other; and a plurality of blades disposed between the plurality of rings, and wherein each of the plurality of blades satisfies following formulas:

$$0.17 \leq B/L \leq 0.2$$

$$95° \leq \beta1 \leq 105°$$

$$35° \leq \beta2 \leq 45°$$

wherein B is a height of the blade, L is a length of a chord of the blade, β1 is an inlet angle of an inlet end of the blade closer to a rotational center of the sirocco fan, and β2 is an outlet angle of an outlet end of the blade farther from the rotational center of the sirocco fan.

20. The air conditioner of claim 19, wherein each of the plurality of blade satisfies a following formula:

$$4.5 \leq d/L \leq 5.5$$

where d is an inner diameter of the sirocco fan.

* * * * *